United States Patent [19]

Stockman

[11] 4,124,063

[45] Nov. 7, 1978

[54] SECTOR PLATE

[75] Inventor: Richard F. Stockman, Friendship, N.Y.

[73] Assignee: The Air Preheater Company, Inc., Wellsville, N.Y.

[21] Appl. No.: 825,877

[22] Filed: Aug. 19, 1977

[51] Int. Cl.[2] ..... F28D 19/00

[52] U.S. Cl. ..... 165/9; 277/26

[58] Field of Search ..... 165/9; 277/26

[56] References Cited

U.S. PATENT DOCUMENTS

| | | | |
|---|---|---|---|
| 3,088,518 | 5/1963 | Rayburn | 165/9 |
| 3,166,119 | 1/1965 | Bellows | 165/9 |
| 3,786,868 | 1/1974 | Finnemore | 165/9 |

*Primary Examiner*—Albert W. Davis, Jr.
*Attorney, Agent, or Firm*—Wayne H. Lang

[57] ABSTRACT

Rotary regenerative heat exchange apparatus having a rotor of heat absorbent element that is alternately exposed to a hot and a cold fluid in order that heat absorbed from the hot fluid may be transferred to the cold fluid. The rotor is surrounded by a housing including a sector plate at opposite ends of the rotor that separates the hot and cold fluids. The sector plate is forcefully deflected to conform to normal "turndown" experienced by the rotor in order that there will be minimum leakage of fluid through the space therebetween.

8 Claims, 9 Drawing Figures

SECTOR PLATE

BACKGROUND OF THE INVENTION

In rotary regenerative heat exchange apparatus a mass of heat absorbent element commonly comprised of packed element plates is first positioned in a hot gas passageway to absorb heat from hot gases passing therethrough. After the plates become heated by the hot gases they are moved to a passageway for a cooler fluid where the then hot plates transmit their heat to cooler air or other gas passing therethrough.

The heat absorbent material is carried in a rotor that rotates between the hot and cool fluids, while a fixed housing including sector plates at opposite ends of the rotor is adapted to surround the rotor. To prevent mingling of the hot and cold fluids, the end edges of the rotor are provided with flexible sealing members that rub against the adjacent surface of the rotor housing and resiliently accommodate a limited degree of "turndown" or other distortion caused by mechanical loading and thermal deformation of the rotor.

To permit turning the rotor freely about its axis, certain minimum clearance space between the rotor and adjacent rotor housing is required, however, excessive clearance is to be avoided because it will dictate excessive leakage. However, under conditions marked by a rapid increase of temperature that is accompanied by excessive expansion of the rotor and of the rotor housing, excessive leakage may develop and a lowered effectiveness may result.

The expansion of the rotor and adjacent rotor housing assumes the greatest proportions directly adjacent the inlet for the hot fluid where an increase of temperature is maximum. An arrangement that compensates for a loss of sealing effectiveness at this, the "hot" end of a rotor, is shown by U.S. Pat. No. 3,786,868 where a plane sector plate is pivoted about a fulcrum carried by the housing. Although such an arrangement is partially effective, excessive fluid leakage between the sector plate and the rotor still continues because the sector plate distorts as a plane while the rotor distorts in a dished configuration.

SUMMARY OF THE INVENTION

In accordance with my invention, I therefore propose to provide a unique actuating device that forces the sector plate to assume a dished configuration that corresponds closely to the dished configuration of the adjacent face of the rotor whereby there will be a minimum clearance space that permits a minimum of leakage therebetween.

BRIEF DESCRIPTION OF THE DRAWINGS

A more complete understanding of my invention may be realized by referring to the following description in conjunction with the accompanying drawings in which.

DESCRIPTION OF THE PREFERRED EMBODIMENT

Figure 1:
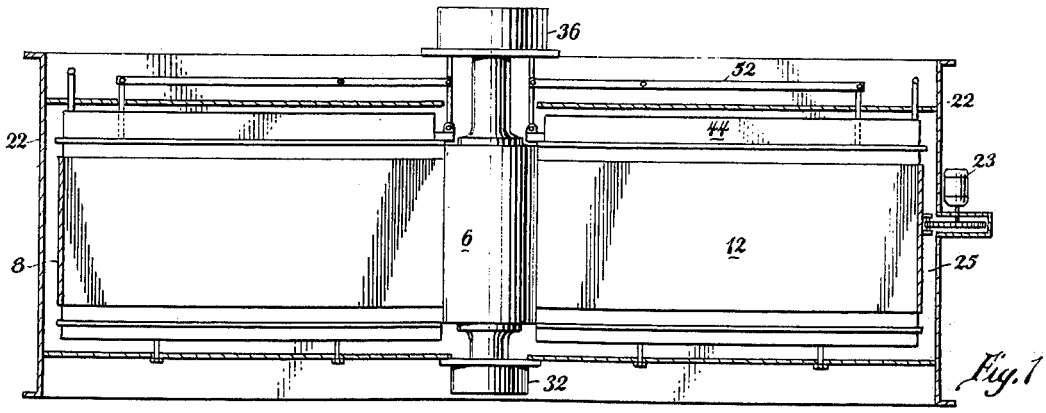
FIG. 1 is a cross section of a rotary regenerative heat exchanger involving the present invention.
Figure 2:
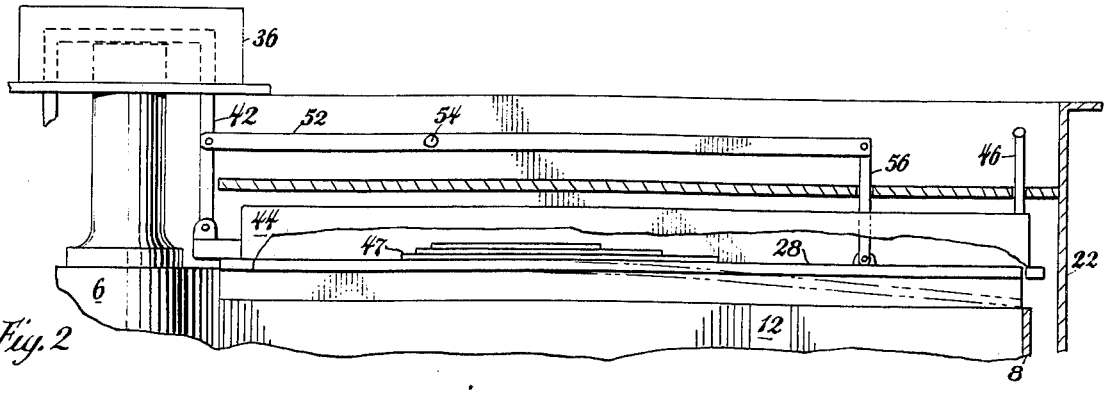
FIG. 2 is a side elevation of the invention.

The heat exchanger includes a vertical rotor post 6 and a concentric rotor shell 8 with a space therebetween that is filled with a mass of permeable heat absorbent element 12 in order that the heat absorbent material that is carried by a rotor and rotated slowly about its axis by a motor 23 may absorb heat from a heating fluid and transfer it to a fluid to be heated.

The hot gas or other heating fluid enters the heat exchanger through an inlet duct 14 and is discharged after traversing the heat absorbent material carried by the rotor 15 through an outlet duct 16. Cool air or other fluid to be heated enters the heat exchanger through an inlet duct 18 and is discharged after flowing over the heated material 12 through an outlet duct 20 to which an induced draft fan is usually connected. After passing over the heated material the cool air absorbs the heat therefrom and is then directed to its place of ultimate use.

A cylindrical housing 22 encloses the rotor in spaced relation thereto to provide an annular space 25 therebetween. Sector plates 28 intermediate ends of the rotor and the adjacent housing structure lie intermediate spaced apertures that admit and discharge the streams of gas and air. In order that streams of gas and air do not bypass the rotor, it is customary to affix flexible sealing means to an end edge of the rotor to confront the adjacent surface of the rotor housing and preclude the flow of fluid therebetween.

In a standard heat exchanger of the type defined herein, the hot gas enters the top of the heat exchanger and transfers its sensible heat to the heat absorbent material of the rotor before it is discharged as a cooled gas through outlet duct 16. Inasmuch as the inlet for the cool air lies at the bottom of the heat exchanger adjacent the cooled gas, the bottom end of the heat exchanger is called the "cold" end while that lying adjacent the hot gas inlet is termed the "hot" end of the rotor. It will be apparent that the "hot" end of the rotor will be subject to maximum temperature variation, while the "cold" end of the rotor will be subjected to a lesser amount.

Figure 9:
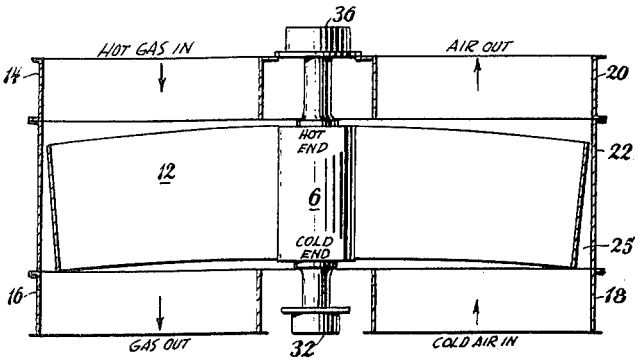
FIG. 9 is a diagrammatic representation of a rotary regenerative heat exchanger having rotor "turndown".

Thus maximum thermal expansion of the rotor housing and the adjacent end of the rotor occurs at the top or "hot" end of the rotor, and in response to a resulting thermal gradient assumes a shape similar to that of an inverted dish shown by FIG. 9 and commonly termed rotor "turndown". The result of this relative thermal expansion of the rotor and the surrounding rotor housing is to increase the clearance space therebetween and substantially increase fluid leakage between the relatively movable parts.

A lower support bearing 32 is mounted rigidly on independent structure and is adapted to support the central rotor shaft 6 for rotation abouts its vertical axis. As the rotor and rotor shaft are heated, they expand axially through a guide bearing 36 that precludes radial displacement of the rotor shaft. Thus the upper portion of the rotor shaft moves upward, while excessive radial expansion of the rotor at the "hot" end of the rotor causes rotor "turndown" and an increase of clearance space between the rotor and rotor housing.

The present invention provides a sealing arrangement at the "hot" end of the rotor wherein the sector plate 28 that lies adjacent thereto is forced to assume a dished configuration that conforms essentially to the adjacent face of the rotor wherein the radial inboard end of the sector plate remains essentially flat, while the radial outboard end of the sector plate is forced to assume a radius of relatively small configuration.

Figure 7:
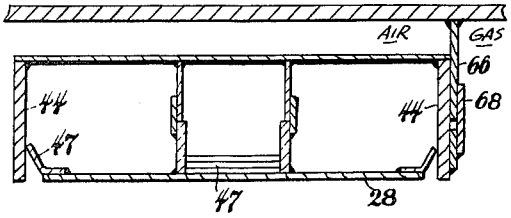
FIG. 7 is a cross section of the sector plate arrangement as seen from line 7—7 of FIG. 5.
Figure 8:
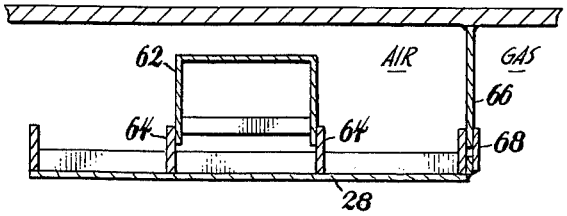
FIG. 8 is a cross section of a modified sector plate as viewed from line 8—8 of FIG. 6.

To carry out this forced bending of the sector plate I provide an axially disposed hanger 42 that is subject to axial movement of the rotor post as effected by thermal expansion thereof whereby the hanger 42 will move up or down in accordance with its change of temperature. The lower end of hanger 42 supports the inboard end of frame 44 that surrounds sector plate 28 and extends radially outward to the periphery of the rotor. The radial inboard end of the frame 44 is carried by the hanger 42, while the inboard end of the surrounding sector plate is attached as by welding to the adjacent portion of the sector shaped frame. The radial outboard end of frame 44 is supported in fixed relation to the adjacent housing structure by a hanger 46, whereby the inboard end of the sector plate is integral with the frame, while the outboard end of the sector plate is axially movable with respect thereto. Sealing means 47 comprising an arrangement of overlapping leaves could be arranged along the radial edges of the sector plate and/or the adjacent surface of the frame 44 to preclude fluid flow through the space therebetween in the manner shown by FIG. 7.

Inasmuch as a rise of temperature causes the rotor to "turndown" in accordance with predetermined principles, the same increase of temperature is utilized to provide an actuating force that moves the outboard end of the upper sector plate into a similar configuration so there may be a minimum of fluid leakage therebetween.

An actuating lever 52 that extends radially outward over sector plate 28 is supported by a fulcrum 54 that is in turn carried by the fixed housing structure. The radial inboard end of the lever 52 is pivotally attached to the hanger 42, while the outboard end thereof is attached by means of a pivotal linkage 56 to the adjacent end of the sector plate 28 whereby axial movement of hanger 42 will produce an opposite movement of the sector plate at linkage 56.

Inasmuch as the sector plate 28 is rigidly attached to the surrounding frame member 44 and stiffeners 47 are provided at the inboard end thereof, the radial outer end of the sector plate is free to move up or down, and actuation by linkage 56 produces a dished configuration of the sector plate that may be made to substantially conform to thermal distortion of the rotor.

The degree of bend at the unsupported end of each sector plate may be varied to conform to the degree of bend on the adjacent face of the rotor by providing stiffeners 44 to the upper surface of the sector plate 28 and moving the fulcrum 54 radially in or out on the fixed housing structure.

Figure 3:
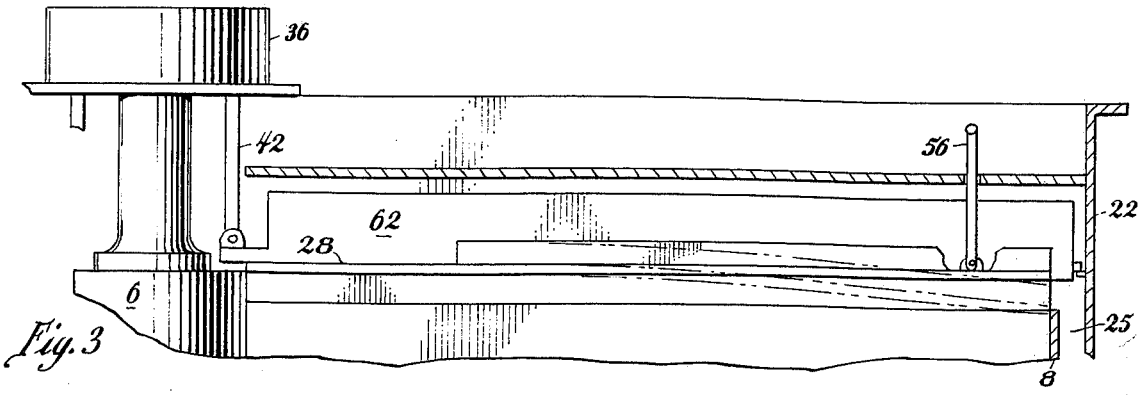
FIG. 3 is a modified form of the invention that may be used with any given actuator.
Figure 4:
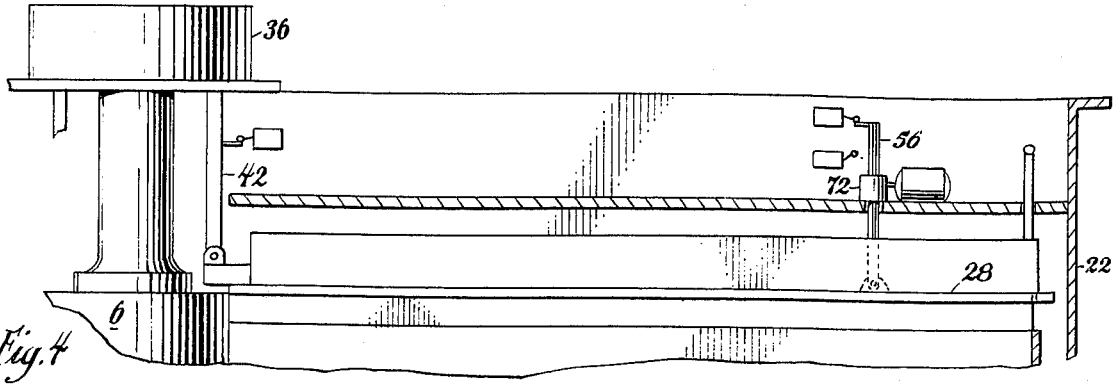
FIG. 4 shows a modified form that utilizes an electric sensing device and actuator for carrying out the invention.
Figure 5:
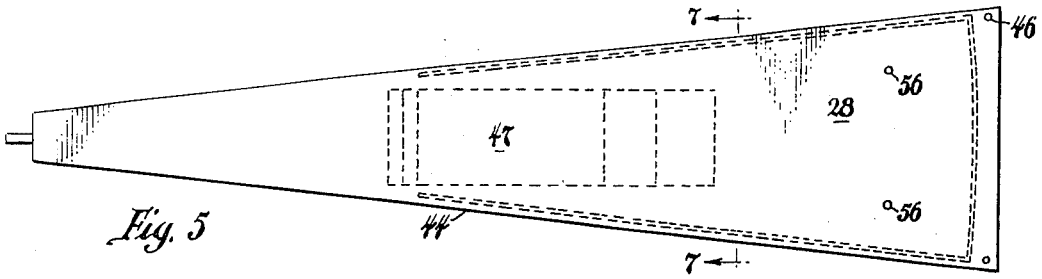
FIG. 5 is a plan view of the device shown in FIG. 2.
Figure 6:
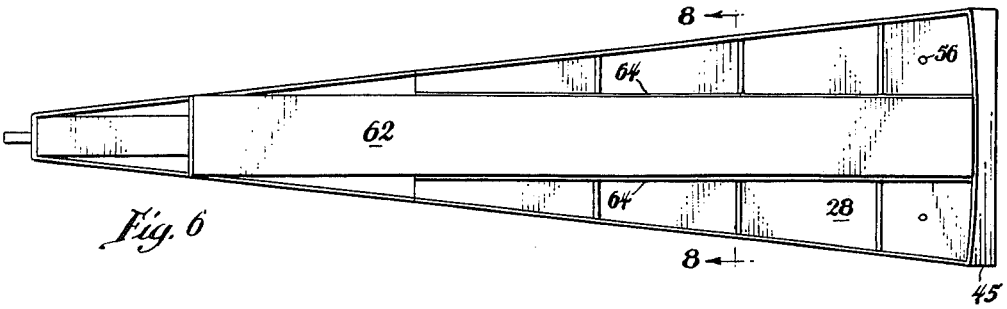
FIG. 6 is a plan view of the device shown in FIG. 3.

A modified arrangement shown in FIG. 3 discloses a sector plate 28 welded to the inner end of a radial support beam 62. The radial beam 62 is carried at its inboard end by the hanger 42 while the outboard end thereof is connected to a "T" shaped member 45 that is in turn carried by housing 22 independent from the sector plate whereby the radial outer end of the sector plate 28 is always free to conform to the actuation of linkage 56. Radial ribs 64 are affixed to the sector plate 28 and adapted to bear against the outer surface of beam 62 sufficient to preclude relative movement in any but an axial direction. Similarly a radial diaphragm or wall is carried by fixed housing structure at the end of the rotor to laterally bear against the relatively movable ribs 68 on the surface of sector plate 28 in a rubbing relationship and thus permit axial movement therebetween. Inasmuch as there is normally a difference in static pressure between the air and the gas streams, contact between the diaphragm 66 and ribs 68 is continuously assured.

Although the invention has been disclosed with reference to a mechanical (lever) actuator, there would be no invention in providing a motor and drive mechanism 72 to drive the actuator 56 at the end of the sector plate. Limit switches 74 responsive to movement of the actuator 56 control movement of the motor-actuator 72 that determines movement of the actuator up or down, while limit switch 74 at the radial opposite end of the sector plate simply controls an "off-on" switch that actuates the drive motor.

It is therefore intended that all matter contained in the above description or shown in the accompanying drawings shall be interpreted as illustrative and limited only by the terms of the accompanying claims.

I claim:

1. Rotary regenerative heat exchange apparatus having a rotor including a central rotor post and a concentric rotor shell spaced therefrom to provide an annular space therebetween, a mass of heat absorbent material carried in the annular space between the rotor post and the rotor shell, a housing surrounding the rotor in spaced relation including inlet and outlet ducts at opposite ends thereof for a heating fluid and for a fluid to be heated, a support bearing at one end of the rotor adapted to support the rotor for rotation about its axis, a guide bearing at the opposite end of the rotor adapted to preclude radial movement of the rotor post, means for rotating the rotor about its axis, a sector plate intermediate the end of the rotor and the rotor housing adapted to maintain the heating fluid separate from the fluid to be heated, support means movable in accordance with axial expansion of the rotor post adapted to support the sector plate at a point adjacent the inboard end of the rotor, and actuating means connected to the outboard edge of the sector plate adapted to deform said sector plate into a curvilinear shape that corresponds to the profile of the rotor.

2. Rotary regenerative heat exchange apparatus as defined in claim 1 wherein the actuating means comprises a radially disposed lever that lies over the sector plate, a fulcrum for said radial lever on fixed housing structure, pivot means connecting said lever to the axially movable support means, and linkage means pivotally connecting the outboard end of said lever to the sector plate whereby said movement of said lever about the fulcrum will force the sector plate into a curvilinear configuration.

3. Rotary regenerative heat exchange apparatus as defined in claim 1 wherein the sector plate is surrounded by a rigid frame of sectorial configuration, and means rigidly attaching the inboard end of the sector plate to the adjacent end of the rigid frame whereby axial movement of the outboard end thereof will force the sector plate into a curvilinear configuration.

4. Rotary regenerative heat exchange apparatus as defined in claim 3 wherein the actuating means that moves the sector plate in an axial direction includes an electrical motor, and a limit switch responsive to axial movement of the support means adapted to actuate the motor to axially move the outboard end of the sector plate relative to said rigid frame.

5. Rotary regenerative heat exchange apparatus as defined in claim 4 including sealing means intermediate the rigid frame and the sector plate that precludes flow of fluid therebetween.

6. Rotary regenerative heat exchange apparatus as defined in claim 1 including a beam extending radially outward from the support means to the rotor housing, means securing the beam to the inboard end of the sector plate, and means supporting the outboard end of the beam on the rotor housing whereby the actuating means at the outboard end of the housing may move the sector plate relating thereto into proximity with the adjacent rotor structure.

7. Rotary regenerative heat exchange apparatus as defined in claim 6 having radial ribs attached to each sector plate that slidably abut the radial support beam to preclude relative lateral movement.

8. Rotary regenerative heat exchange apparatus as defined in claim 7 wherein the actuating means adapted to move the sector plate in an axial direction includes an electrical motor, means responsive to axial movement of the support means adapted to actuate the motor, and means responsive to movement of the sector plate adapted to terminate actuation of the motor.

* * * * *